US005538131A

United States Patent [19]

Harrelson

[11] Patent Number: 5,538,131

[45] Date of Patent: Jul. 23, 1996

[54] BASKET-STYLE ARTICLE CARRIER WITH IMPROVED PARTITION LAYOUT

[75] Inventor: Glen R. Harrelson, Roswell, Ga.

[73] Assignee: Riverwood International Corporation, Atlanta, Ga.

[21] Appl. No.: 391,899

[22] Filed: Feb. 21, 1995

[51] Int. Cl.[6] ..... B65D 75/00

[52] U.S. Cl. ..... 206/162; 206/170; 206/174; 206/185; 206/186; 206/197

[58] Field of Search ..... 206/141, 142, 206/147, 148, 149, 152, 156, 162, 165, 167, 170, 172, 174, 175, 180, 183, 184, 185, 189, 193, 197, 200, 427, 186; 294/87.2

[56] References Cited

U.S. PATENT DOCUMENTS

| | | | |
|---|---|---|---|
| 2,660,361 | 11/1953 | Tyrseck | 206/180 X |
| 2,772,020 | 11/1956 | Kramer | 206/180 |
| 3,352,452 | 11/1967 | Graser | 206/172 |
| 3,893,565 | 7/1975 | Rossi et al. | 206/183 |
| 4,205,748 | 6/1980 | Wilson | 206/174 |
| 4,782,944 | 11/1988 | Engdahl, Jr. | 206/185 |
| 5,167,325 | 12/1992 | Sykora | 206/143 |
| 5,234,103 | 8/1993 | Schoster | 206/158 |

*Primary Examiner*—Paul T. Sewell
*Assistant Examiner*—Tara L. Laster

[57] ABSTRACT

A basket-style carrier for packaging six bottles or other articles in two adjacent rows. Partition panels connected to opposite side panels are formed from partition flaps foldably connected to the upper edge of the side panels of the carrier. The partition flaps are adhered to the side panels and the partition panels are adhered to the central handle panel.

5 Claims, 3 Drawing Sheets

BASKET-STYLE ARTICLE CARRIER WITH IMPROVED PARTITION LAYOUT

FIELD OF THE INVENTION

This invention relates to a basket-style carrier for packaging articles such as beverage bottles. More particularly, it relates to basket-style carrier for packaging six articles.

BACKGROUND OF THE INVENTION

Basket-style carriers are commonly employed to package beverage bottles. They typically include a separate cell for each bottle, from which the bottles can readily be removed, and a central handle panel for easily carrying the package. Contact between adjacent bottles is prevented by transverse partitions and by a center longitudinal partition in order to prevent breakage of the bottles. Normally, basket-style carriers of this type which are designed to hold six bottles are fabricated from blanks in which the side and end panels and the center handle panel are connected to each other in serial fashion to form an elongated rectangular arrangement, with the cell dividing transverse partitions being formed from flaps connected to the top or bottom edge of the center handle panel. The formation of a carrier requires these flaps to be folded into place prior to the ends of the flaps being glued to the side panels to hold the partitions in place.

One problem with this arrangement is the extent to which the divider partition flaps extend transversely from the panel sections. This results in a web layout in which the blanks are relatively widely spaced from each other, resulting in a substantial amount of material usage. In addition, the relatively complicated gluing operation made necessary by the transverse layout of the divider partition flaps and the relatively slow speed of the moving web made necessary by the need to fold the cell divider partition flaps of this arrangement into place add to the cost of the carriers.

An object of the invention is to provide a six-bottle carrier which can be formed from a more efficient layout with respect to material usage and the required gluing pattern. Another object is to provide a carrier of this type which is capable of providing full protection to the packaged bottles.

BRIEF SUMMARY OF THE INVENTION

As is typical of basket-style carriers, the carrier of the invention comprises a bottom panel, side panels, end panels and a central handle panel. The handle panel is connected at opposite ends to the end panels, and partition panels extend between the handle panel and the side panels. A partition flap foldably connected to the upper edge of each side panel is adhered to the inner face of the side panel and two partition panels are connected to each partition flap. Each partition flap contains a cutout portion from which one of the partition panels has been formed.

Preferably, each partition panel is foldably connected at one end to a partition flap and at the other end to a glue flap adhered to the handle panel. Also, the partition panel which is not formed from a cutout portion in a partition flap preferably is foldably connected to an edge of the partition flap and contains a cutout portion from which the glue flap of the other partition panel has been formed.

The carrier is formed from an elongated blank which includes a partial end panel at one end and a handle panel section at the other end. The blank can be rapidly folded and glued to form a collapsed carrier which subsequently is opened during the packaging operation.

These and other features and aspects of the invention will be readily ascertained from the detailed description of the preferred embodiment described below.

DETAILED DESCRIPTION OF THE PREFERRED EMBODIMENT

Figure 1:
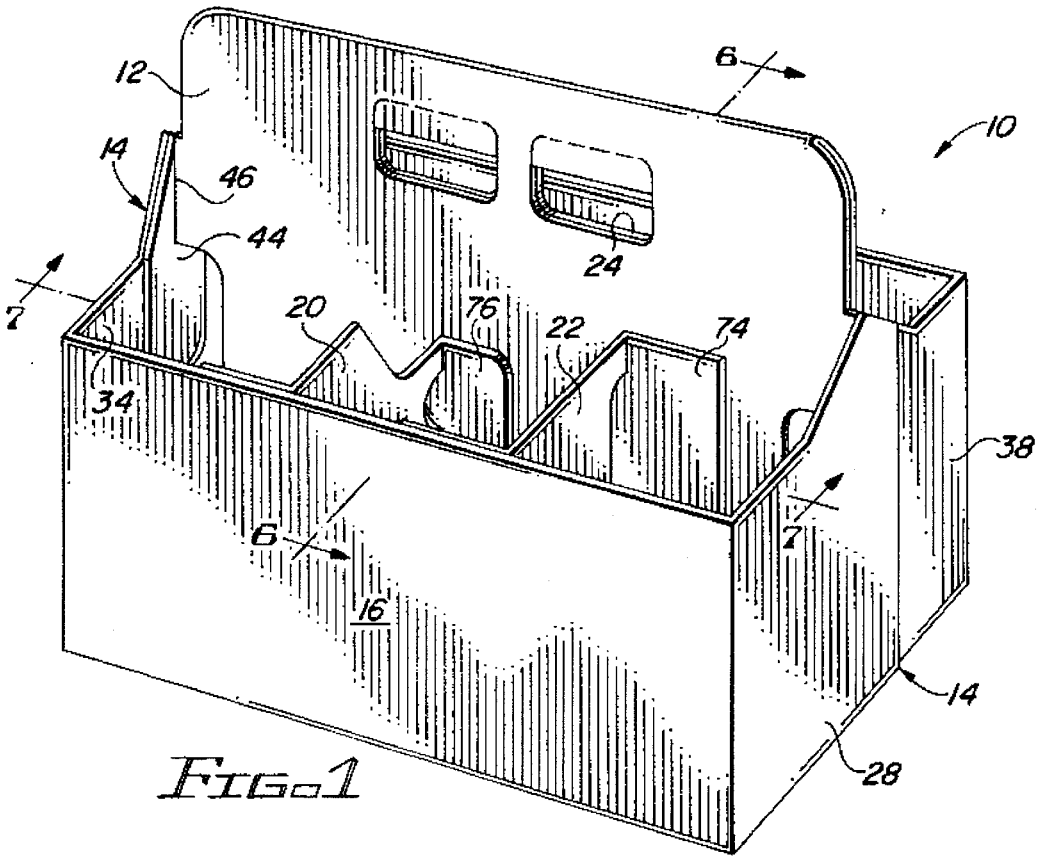
FIG. 1 is a pictorial view of a basket-style carrier incorporating the invention.

Referring to FIG. 1, the basket-style carrier 10 of the invention includes a central handle panel 12 connected to end panels 14. The end panels are connected to side panels 16 and 18, and the side panels are connected to a bottom panel, not visible in this view. Individual cells for receiving bottles or other articles are formed by transverse partitions 20 and 22 which extend from the side panels to the handle panel 12. Only the partitions on the side of the handle panel facing the viewer are visible in the drawing, but it will be understood that similar partitions are arranged on the other side of the handle panel. The handle panel includes handle grip openings 24. Additional features of the carrier indicated by other reference numerals in this drawing figure will be referred to below in connection with other drawing figures.

Figure 2:
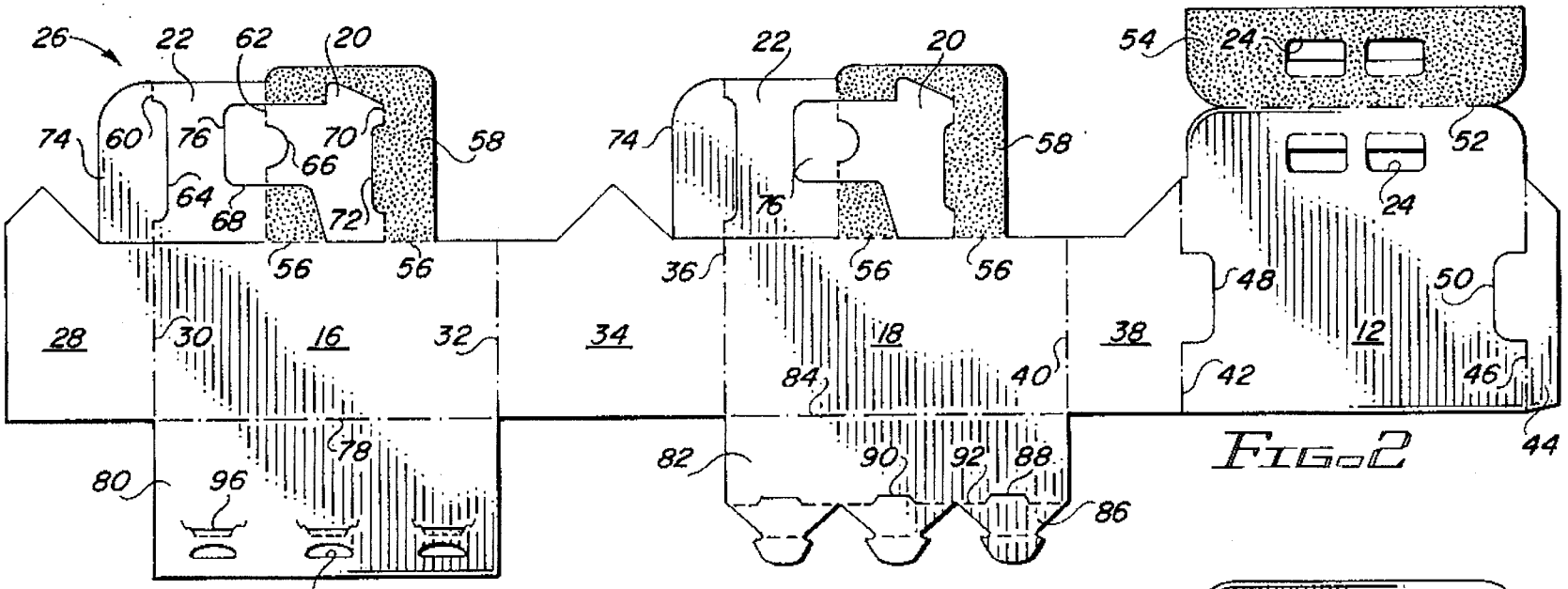
FIG. 2 is a plan view of a blank for fabricating the carrier.

Referring to FIG. 2, wherein like reference numerals to those used in FIG. 1 denote like elements, a blank 26 is shown as being of generally elongated rectangular shape with bottom panel flaps and a handle flap extending transversely from the basic shape. At one end of the blank partial end panel flap 28 is connected by fold line 30 to side panel section 16, which in turn is connected by fold line 32 to end panel section 34. The other side panel section 18 is connected to the end panel section 34 by fold line 36 and to partial end panel section 38 by fold line 40. At the other end of the blank the handle panel section 12 is connected to the partial end panel section 38 by fold line 42 and to glue flap 44 by fold line 46. The fold line 42 is interrupted by slit 48, which defines an extension of the partial end panel section 38. Similarly, the fold line 46 is interrupted by slit 50, which defines an extension of the glue flap 44. Connected by fold line 52 to the upper edge of the handle panel section 12 is a handle panel extension 54 which, like the handle panel section 12, contains handle openings 24.

Connected to the upper edge of the side panel section 16 by interrupted fold line 56 is partition flap 58. The partition flap includes two interrupted vertical fold lines 60 and 62, the former being aligned with and extending down to the fold line 30 and the latter extending down to the outer end of the fold line 56. Interrupting the fold lines 60 and 62 and extending transversely from the fold lines are slits 64 and 66, respectively. In addition, continuous slit 68 extends from the partition flap 58, across the upper fold line segment 62 and back past the lower fold line segment 62. A portion of the slit 68 coincides with the portion of the upper edge of the side panel section between the fold line segments 56. The ends of the slit 68 terminate at the ends of vertical fold line 70, which is interrupted by transversely extending slit 72. The slit 64 and the fold line segments 60 form a glue flap 74 at one end of the partition 22, while the portions of the partition flap 58 adjacent the fold line segments 62 function as a glue flap for the other end of the partition 22. In like manner, the slits 66 and 68 and the portions of the fold line segments 62 within the horizontal runs of the slit 68 form a glue flap 76 at one end of the partition 20, while the portions of the partition flap 58 adjacent the fold line segments 70 function as a glue flap for the other end of the partition 20. A similar arrangement of a partition flap 58 and partitions 20 and 22 is provided in connection with the side panel section 18.

Connected to the lower edge of the side panel section 16 by fold line 78 is inner bottom panel flap 80, while outer bottom panel flap 82 is connected to the lower edge of the side panel section 18 by fold line 84. The outer bottom panel flap 82 includes secondary locking tabs 86 and primary locking tabs 88, the latter being formed by slits 90 which interrupt fold line 92. Primary locking openings 94 and secondary locking slits 96 are provided in the inner bottom panel flap 80 to receive the primary and secondary locking tabs.

The fold lines 30, 32, 36, 40, 42 and 46 are parallel to each other and extend vertically in a carrier formed from the blank, while the fold lines 78 and 84 are aligned with the lower edges of the main rectangular body of the blank and form substantially right angles with the vertical fold lines.

To form a carrier from the blank glue is applied to the handle panel extension 54 and to the glue flaps 58, as shown in stipple in FIG. 2. No glue is applied to the partitions 20 and 22 or to the glue flaps 74 and 76. The handle panel extension 54 is folded down about the fold line 52 to adhere it to the upper portion of the handle panel section 12 so as to make the area surrounding the aligned handle openings 24 of two-ply construction. The partition flaps 58 are folded down about the fold lines 56 to adhere the partition flaps to the side panel sections 16 and 18. The resulting interim configuration of the blank is shown in FIG. 3.

Figure 3:
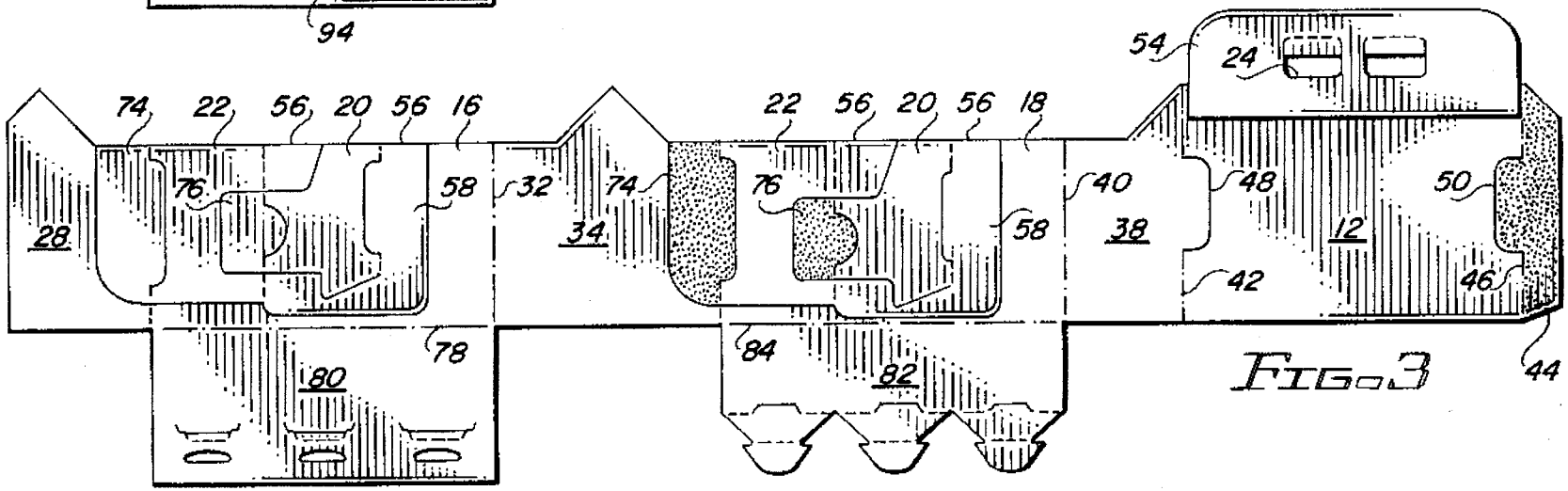
FIG. 3 is a plan view of the carrier blank after an initial folding step.

Glue is then applied as shown in stipple in FIG. 3 to the glue flap 44, to the glue flap 74 overlying the end panel section 34 and to the glue flap 76 overlying the side panel section 18. The handle panel section 12 and the partial end panel section 38 are then pivoted about the fold line 40 to the position shown in FIG. 4. The glue flap 44 is thus adhered to the underlying end panel section 34 and the glue flaps 74 and 76 are adhered to the overlying handle panel section 12.

Figure 4:
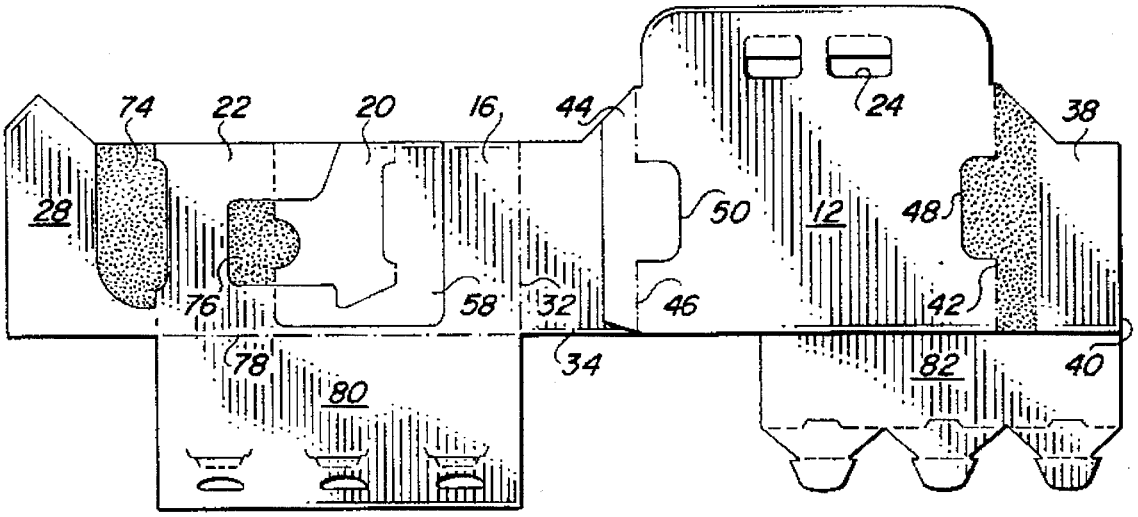
FIG. 4 is a plan view of the carrier blank after an intermediate folding step.
Figure 5:
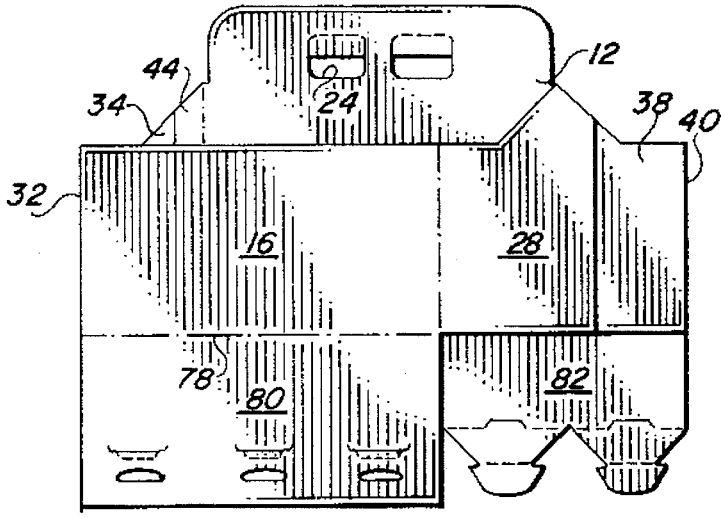
FIG. 5 is a plan view of a collapsed carrier resulting from a final folding step.

Glue is then applied as shown in stipple in FIG. 4 to the portion indicated of the partial end panel section 38, to the glue flap 74 overlying the partial end panel section 28 and to the glue flap 76 overlying the side panel section 16. The side panel section 16 and the partial end panel section 28 are then pivoted about the fold line 32 to form the collapsed carrier shown in FIG. 5. The partial end panel sections 28 and 38 are thus adhered to each other and the glue flaps 74 and 76 shown in FIG. 4 are adhered to the underlying handle panel section 12. After the collapsed carrier is squared up by applying opposed inward pressure to the end folds 32 and 40, the bottom panel of the carrier can be formed.

The particular design of the bottom panel of the carrier is not a feature of the invention, and the bottom panel may therefore be of any suitable design. As to the formation of the bottom panel from the blank design shown, it will be understood by those familiar with the carrier art that after the collapsed carrier has been squared up the bottom panel flaps 80 and 82 are folded so that the edge portion of the flap 82 overlaps the edge portion of the flap 80. By first folding the outer portion of the flap 82 back along the fold line 92 and then back again toward its normal planar position, the primary locking tabs 88 can be engaged with the straight edges of the locking openings 94. Then the secondary locking tabs 86 can be inserted into the slits 96 to prevent the primary locks from disengaging. Completion of the bottom panel results in the carrier of FIG. 1.

Figure 7:
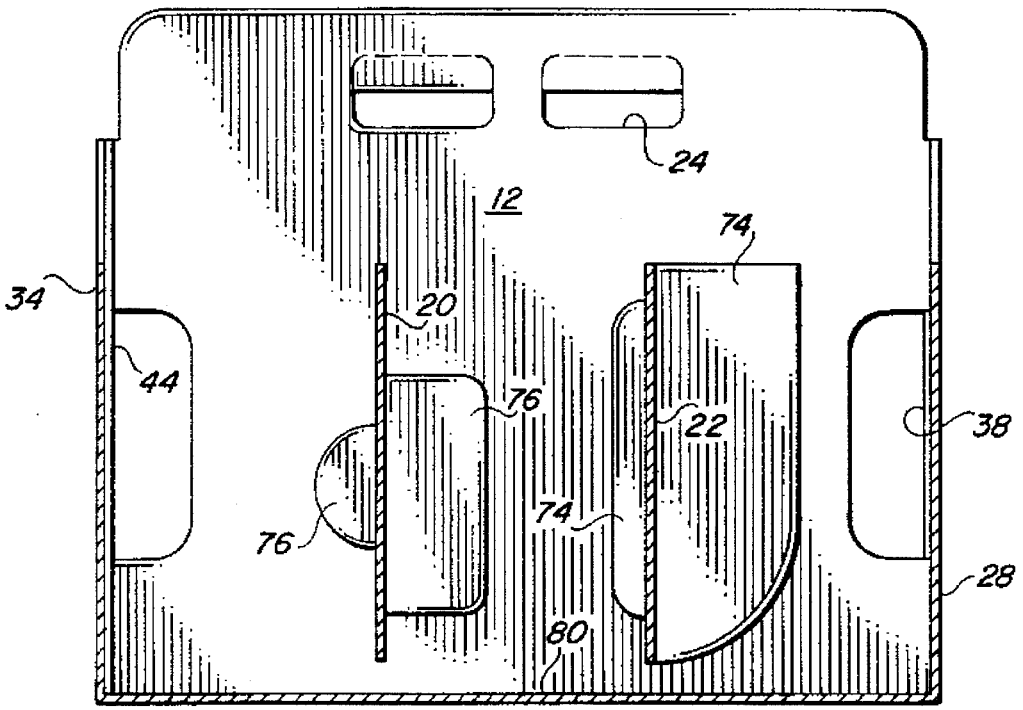
FIG. 7 is a sectional view taken along the line 7—7 of FIG. 1.
Figure 6:
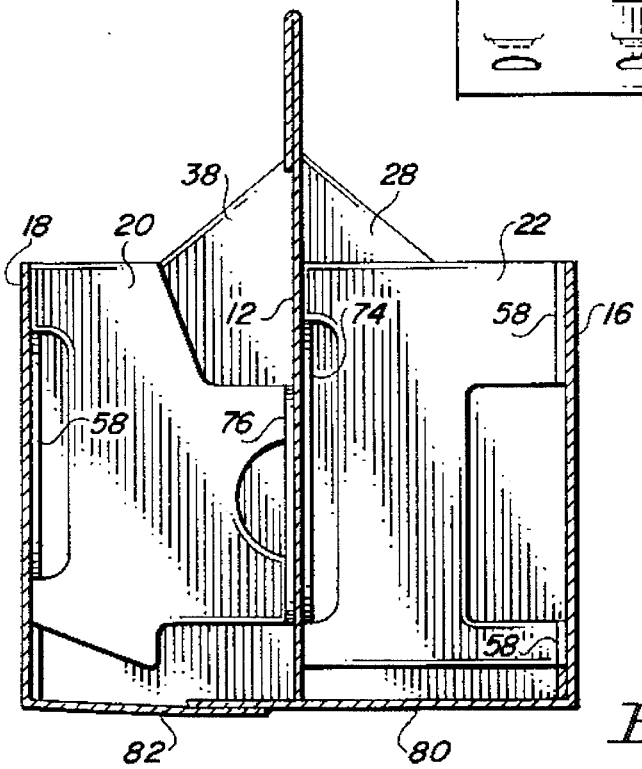
FIG. 6 is a sectional view taken along the line 6—6 of FIG. 1.

As best shown in FIGS. 1, 6 and 7, the handle panel 12 of the carrier is integrally connected to the partial end panel section 38 and is connected to the end panel 34 by the glue flap 44. It is also connected to the partition panels 20 and 22 by glue flaps 76 and 74, respectively. The partition panels 20 and 22 are connected to the side panels by the partition flaps 58. The result is a very sturdy six-bottle carrier which provides effective bottle separation.

It will be understood that the specific shapes of the partitions 20 and 22 may vary from the design illustrated in the drawing. It is expected that the periphery of the partitions will be irregular in shape, however, in order to provide for the integral connection of the partitions to the partition flap 58 and to allow the partition 20 to be punched out of the partition flap along the slits 68 and 70. In addition, the height of the partitions should be such that they prevent adjacent bottles from contacting each other.

Because the partitions are formed from partition flaps which are connected to the upper edges of the side panel sections, the usual need to connect partitions to the handle panel is eliminated, thereby eliminating substantial transverse projections of the blank. This allows the blank to be laid out in the web from which it is die cut so that the space between adjacent blanks is minimized, thus reducing material usage. A further benefit of the design is that the gluing operation can be performed at high rates of speed. This is made possible by the fact that the blank is quite narrow, making the area over which glue is introduced quite narrow as well, thereby enabling the blanks to be moved past the glue heads at more rapid rates of speed than normal. Since this permits the carrier blanks to be formed at higher rates of speed, the cost of the operation is reduced.

Although the carrier has been described in connection with a basket-style carrier for packaging bottles, it will be understood that it may be used to package other types of articles as well, particularly articles which should not be permitted to come into direct contact with each other.

The various design features described contribute to the ability to rapidly and economically produce an effective, strong basket-style carrier for holding six articles. It will be understood, however, that the invention is not limited to all the specific details described in connection with the preferred embodiment, except as they may be within the scope of the appended claims, and that changes to certain features of the preferred embodiment which do not alter the overall basic function and concept of the invention are contemplated.

What is claimed is:

1. An elongated blank for forming a basket-style carrier for packaging six articles arranged in two adjacent rows, comprising:

an end panel section having opposite substantially parallel first an second transverse edges;

a first side panel section having upper and lower edges and first and second transverse edges, the first transverse edge thereof being connected to the first transverse edge of the end panel section;

a second side panel section having upper and lower edges and first and second transverse edges, the first transverse edge thereof being connected to the second transverse edge of the end panel section;

a first partial end panel section connected to the second transverse edge of the first side panel section;

a second partial end panel section having first and second transverse edges, the first transverse edge thereof being connected to the second transverse edge of the second side panel section;

a handle panel section connected to the second transverse edge of the second partial end panel section;

a partition flap connected by a fold line to the upper edge of each side panel section;

each partition flap containing a slit defining a first partition panel connected to the partition flap by a fold line;

each partition flap being connected by a fold line to a second partition panel;

means for connecting the partition panels to the handle panel section of a carrier formed from the blank; and means connected to the blank for forming a bottom panel in such a carrier.

2. A basket-style carrier blank as defined in claim 1, wherein the means for forming a bottom panel is comprised of at least one bottom panel flap connected by a fold line to the lower edge of one of the side panel sections.

3. A basket-style carrier blank as defined in claim 1, wherein the means for forming a bottom panel is comprised of a bottom panel flap connected by a fold line to the lower edge of each of the side panel sections.

4. A basket-style carrier blank as defined in claim 1, wherein the means for connecting the partition panels to the handle panel section of a carrier formed from the blank is comprised of a glue flap connected by fold line to each of the partition panels.

5. A basket-style carrier blank as defined in claim 4, wherein the fold line connecting a glue flap to each first partition panel is substantially a continuation of the fold line connecting an associated second partition panel to the partition flap associated with said first and second partition panels.

* * * * *